US012303084B2

(12) United States Patent
Heiland et al.

(10) Patent No.: US 12,303,084 B2
(45) Date of Patent: May 20, 2025

(54) CLEANING DEVICE FOR WET CLEANING

(71) Applicant: CARL FREUDENBERG KG, Weinheim (DE)

(72) Inventors: Marc Heiland, Worms (DE); Christian Stenglein, Frankfurt am Main (DE)

(73) Assignee: CARL FREUDENBERG KG, Weinheim (DE)

( * ) Notice: Subject to any disclaimer, the term of this patent is extended or adjusted under 35 U.S.C. 154(b) by 319 days.

(21) Appl. No.: 17/909,449

(22) PCT Filed: Mar. 1, 2021

(86) PCT No.: PCT/EP2021/054997
§ 371 (c)(1),
(2) Date: Sep. 6, 2022

(87) PCT Pub. No.: WO2021/190862
PCT Pub. Date: Sep. 30, 2021

(65) Prior Publication Data

US 2023/0135446 A1 May 4, 2023

(30) Foreign Application Priority Data

Mar. 27, 2020 (DE) ..... 10 2020 108 607.5

(51) Int. Cl.
*A47L 11/40* (2006.01)
*A47L 11/282* (2006.01)

(52) U.S. Cl.
CPC ..... *A47L 11/4047* (2013.01); *A47L 11/282* (2013.01); *A47L 11/405* (2013.01); *A47L 2201/04* (2013.01)

(58) Field of Classification Search
CPC ..... A47L 11/282; A47L 11/28; A47L 11/40
See application file for complete search history.

(56) References Cited

U.S. PATENT DOCUMENTS 2,259,941 A * 10/1941 Primeaux ..... A47L 11/4075 15/97.1
3,686,699 A * 8/1972 Knestele ..... A47L 11/325 15/22.3

(Continued)

FOREIGN PATENT DOCUMENTS

CN 106333630 A * 1/2017
CN 107280595 A * 10/2017 ..... A47L 11/284

(Continued)

*Primary Examiner* — Michael D Jennings
(74) *Attorney, Agent, or Firm* — LEYDIG, VOIT & MAYER, LTD.

(57) ABSTRACT

A cleaning device includes: a housing; a drive device for automatically moving the cleaning device in a movement direction; and a wet-cleaning module accommodated in the housing, the wet-cleaning module including a moveable cleaning element for wet cleaning of surfaces. The cleaning element is belt-shaped. In an embodiment, the wet-cleaning module has three positions for the belt-shaped cleaning element: a cleaning position, in which the cleaning element is configured to contact a surface to be cleaned with a cleaning surface; a parking position, in which the cleaning element is at a distance from the surface to be cleaned; and a regeneration position located between the cleaning position and the parking position, or a regeneration position located in the parking position in which the cleaning element is regeneratable. The wet-cleaning module has a transport mechanism for moving the cleaning element into its cleaning, parking, and regeneration positions.

15 Claims, 4 Drawing Sheets

(56) References Cited

U.S. PATENT DOCUMENTS

| | | | | |
|---|---|---|---|---|
| 5,001,800 | A * | 3/1991 | Parenti | E04H 4/1654 15/387 |
| 6,311,356 | B1 * | 11/2001 | Wang | A47L 11/4052 15/99 |
| 2002/0124334 | A1 * | 9/2002 | Worwag | A47L 9/0494 15/384 |
| 2005/0229340 | A1 | 10/2005 | Sawalski | |
| 2005/0241086 | A1 | 11/2005 | Damrath | |
| 2006/0140703 | A1 * | 6/2006 | Sacks | A47L 13/22 401/139 |
| 2009/0126145 | A1 * | 5/2009 | D'Agostino | A47L 9/2836 15/246.3 |
| 2010/0122422 | A1 * | 5/2010 | Hui | E04H 4/1654 15/1.7 |
| 2015/0143658 | A1 * | 5/2015 | Jang | A47L 11/4044 15/347 |
| 2016/0022111 | A1 | 1/2016 | Scolari | |
| 2016/0270619 | A1 | 9/2016 | Lu | |
| 2017/0119228 | A1 | 5/2017 | Dingert | |
| 2019/0142237 | A1 | 5/2019 | Isenberg | |
| 2020/0000302 | A1 | 1/2020 | Morin | |
| 2020/0196817 | A1 | 6/2020 | Fang | |
| 2022/0378267 | A1 | 12/2022 | Fang | |

FOREIGN PATENT DOCUMENTS

| | | | | |
|---|---|---|---|---|
| CN | 109528093 | A | 3/2019 | |
| DE | 10256089 | A1 | 6/2004 | |
| DE | 102014008954 | B3 | 9/2015 | |
| DE | 102016002922 | A1 | 9/2017 | |
| DE | 102017126414 | A1 | 5/2019 | |
| KR | 20120129191 | A | 11/2012 | |
| WO | WO-2013082877 | A1 * | 6/2013 | A47L 11/26 |

* cited by examiner

CLEANING DEVICE FOR WET CLEANING

CROSS-REFERENCE TO PRIOR APPLICATIONS

This application is a U.S. National Phase application under 35 U.S.C. § 371 of International Application No. PCT/EP2021/054997, filed on Mar. 1, 2021, and claims benefit to German Patent Application No. DE 10 2020 108 607.5, filed on Mar. 27, 2020. The International Application was published in German on Sep. 30, 2021 as WO 2021/190862 under PCT Article 21(2).

FIELD

The invention relates to a cleaning device and to a method for operating such a cleaning device.

BACKGROUND

A variety of automatically driving cleaning devices for the wet cleaning of floor surfaces are known from the state of the art. DE 10 2017 126 414 A1 shows a cleaning device for the wet cleaning of floor surfaces, which has a disc-shaped cleaning element comprising a cleaning cloth, which can be raised and lowered. This allows the cleaning element to be brought into contact with the surface to be cleaned. The cleaning element has a relatively large cleaning surface. This has the result that the dimensions of the cleaning device are not compact.

When the cleaning device travels over the surface for cleaning the surface, the dirt is collected mainly in the front area of the cleaning element. Uniform use of the cleaning surface is therefore not possible and the cleaning element must be replaced, even though it still has areas with little soiling.

In the state of the art, cleaning devices for the wet cleaning of floor surfaces are also known, which have rotating brushes as cleaning elements. With such devices, however, there is only essentially linear contact between the cleaning element and the surface to be cleaned. This makes it more difficult to pick up dirt from the surface to be cleaned.

SUMMARY

In an embodiment, the present invention provides a cleaning device, comprising: a housing; a drive device configured to automatically move the cleaning device in a movement direction; and a wet-cleaning module accommodated in the housing, comprising a moveable cleaning element for the wet cleaning of surfaces to be cleaned, wherein the cleaning element is belt-shaped.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
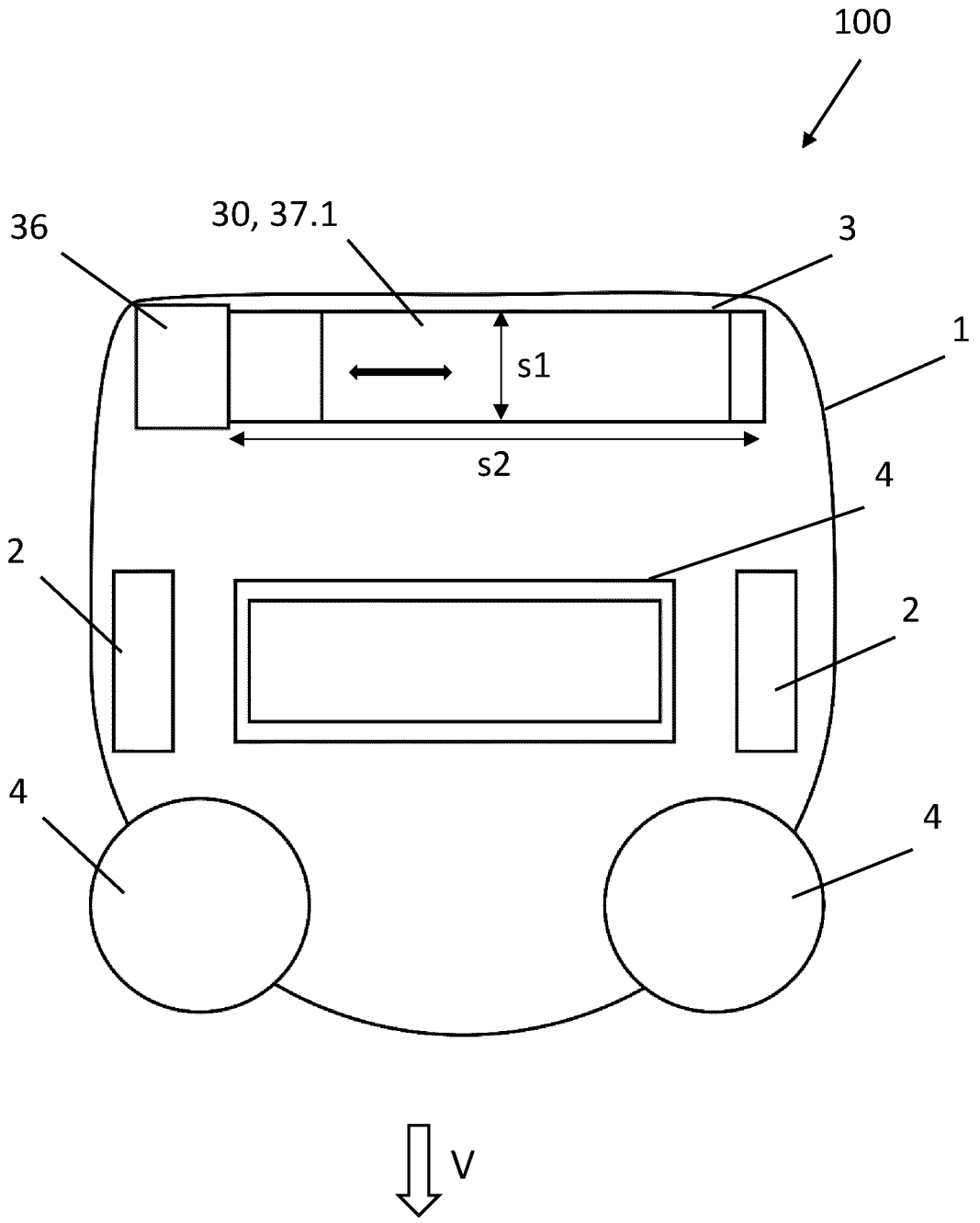
FIG. 1 schematically shows a cleaning device in a bottom view.

In an embodiment, the present invention provides a cleaning device which has a compact structure and which at the same time provides good cleaning performance.

According to the invention, it has been found to be advantageous for the cleaning element to have a belt-shaped design, which allows good utilization of the cleaning surface of the cleaning element:

The cleaning device according to the invention has a housing, a drive device for automatically moving the cleaning device in a movement direction and a wet-cleaning module accommodated in the housing. The movement direction can also be referred to as the main direction of movement. The wet-cleaning module has a movable cleaning element with a cleaning surface for contacting and cleaning the surface to be cleaned. The cleaning device is designed for the wet cleaning of surfaces to be cleaned, in particular floors. According to the invention, the cleaning element has a belt-shaped design, i.e., it is relatively thin and long, in particular comprising a cleaning cloth. The advantage of this cleaning element design is that the belt-shaped cleaning element provides a relatively large cleaning surface compared to cleaning brushes, while at the same time ensuring good utilization of the cleaning surface. Thanks to the belt-shaped design of the cleaning element, a compact structure of the cleaning device is also possible.

In a particularly advantageous and therefore preferred further development of the cleaning device, the wet-cleaning module features three positions for the belt-shaped cleaning element:

The first position is a cleaning position in which the cleaning element contacts the surface to be cleaned with the cleaning surface of the cleaning element.

The second position is a parking position in which the cleaning element is at a distance from the surface to be cleaned.

And the third position is a regeneration position located between the cleaning position and the parking position, in which the cleaning element can be regenerated, i. e., cleaned and reconditioned. Alternatively, the parking position and regeneration position can coincide and have a common position, i.e., both the regeneration position and the parking position are in the second position. During regeneration, whereby the cleaning element is regenerated, i. e., cleaned and reconditioned, the position serves as the regeneration position. If no regeneration is in progress, the position serves as the parking position.

The wet-cleaning module is also equipped with a transport mechanism for moving the cleaning element to its cleaning position, its parking position and its regeneration position.

A cleaning device of this type advantageously ensures that the cleaning element does not have to be replaced after use and in the event of a high degree of soiling, but rather can be regenerated, i. e., reconditioned, in the cleaning device itself. It is also ensured that the cleaning element only contacts the surface to be cleaned when cleaning is to be carried out. If the surface to be cleaned is, for example, a parquet floor, it is particularly important that the wet cleaning module only contacts the parquet to be cleaned during the cleaning process. This prevents swelling of the parquet and the formation of water spots.

In an advantageous embodiment of the cleaning device described above, the transport mechanism is designed as at least one circulating belt with at least one drive roller and at least one reversing roller. The at least one circulating belt can also be configured as a pair of circulating, parallel belts.

The cleaning element is attached and fixed to the outer surface of the circulating belt using fixing means. Fixing can be carried out, for example, by means of a hook and loop fastener or by means of press studs. This enables easy replacement of the cleaning element and facilitates external intensive cleaning, for example by means of washing in a washing machine. The reversing roller of the transport mechanism can be either exclusively used for reversing or have the additional function of driving the belt and thus also be designed as a drive roller.

In an advantageous further development of the cleaning device according to the invention, the wet-cleaning module has a regeneration unit for cleaning the cleaning element, comprising at least one cleaning brush and/or a stripping comb and/or a spraying device for wetting and/or rinsing the cleaning element and/or a water tank and/or a pair of squeezing rollers and/or a disinfecting means. A disinfecting means can be a device in which disinfection of the cleaning element takes place. If necessary, a disinfectant, i. e., a disinfecting liquid, can also be used. A UV lamp can also be used as a disinfecting means, for example, to irradiate the cleaning element. It is also possible, for example, to provide two water tanks, a fresh water tank and a waste water tank.

In a particularly advantageous and therefore preferred further embodiment of the cleaning device according to the invention, the following applies with regard to the dimensions of the cleaning surface of the cleaning element: The extension in the movement direction of the cleaning device is smaller than the extension perpendicular to the movement direction of the cleaning device. In other words, the depth of the cleaning surface is smaller than the width of the cleaning surface. In particular, the depth is max. 10 cm, especially max. 3-6 cm. Given that most of the dirt is generally collected in the front area—as seen in the direction of movement of the cleaning device—it is thus possible to achieve a cleaning device having a compact structure combined with a wide cleaning area and good cleaning performance.

Tests have shown that it is particularly advantageous if the cleaning element is movable perpendicular to the direction of movement of the cleaning device. In particular, when the cleaning element is configured as a circulating belt, it is advantageous if the belt can be moved back and forth perpendicular to the direction of movement. This generates an effective scrubbing movement of the cleaning element and thereby improves the cleaning performance.

In one possible embodiment of the cleaning device, the cleaning element is made of a textile material. The textile material may, for example, be a microfiber. Alternatively, the textile material may be a mixture of microfibers and other textiles. It is further advantageous if the cleaning element is comprised of different plies or layers.

If the cleaning element is made of a textile material, it has been found advantageous to use plastic elements, e.g., plastic strips, to stiffen the cleaning surface of the cleaning element. Alternatively, stiffening can be achieved by joining additional textile strips to the textile material. This has the advantage that the area of the cleaning surface of the cleaning element remains dimensionally stable.

In an advantageous embodiment of the cleaning device, the cleaning element has, in a cleaning position or in its cleaning position, a horizontal cleaning surface for cleaning a horizontal surface, e.g., a floor, and a vertical cleaning surface for cleaning a vertical surface, e.g., a skirting board.

In a further development, the cleaning surface of the cleaning element can be convexly curved at least in areas, whereby the curvature extends perpendicular to the direction of movement of the cleaning device. Particularly preferably, the cleaning surface of the cleaning element has a planar cleaning surface which is adjoined by convex curvatures in and against the direction of movement. One advantage of a cleaning surface of this type is, among other things, that the area of the cleaning element contacting the surface to be cleaned is embedded in a stable manner and thus exhibits less wear as a result of frictional stress. Alternatively, or additionally, the cleaning surface can be located between at least two ramps raised relative to the edges of the cleaning surface in such a way that unintentional detachment of the cleaning element due to obstructions or interfering objects on the surface to be cleaned is prevented.

In a further development of the cleaning device, it is equipped with a sensor, in particular an optical sensor, for detecting the surface to be cleaned or the cleaned surface and to determine cleaning performance. The sensor can be arranged in particular above the cleaning element in its cleaning position and can be activated when the cleaning element is located outside of its cleaning position (A), for example in its parking position. Advantageously, this enables the cleaning result to be determined immediately after cleaning without the need to move the position of the cleaning device. Rather, the cleaning element only has to be moved from its cleaning position to the parking position. The result of the assessment or the result of the ascertained cleaning performance can, for example, be displayed on the user's smartphone via an app.

It is preferable if the cleaning element of the cleaning device is provided with a means of communication, which in particular is provided with an electrically readable identifier, to communicate with the cleaning device. The means of communication may be, for example, QR codes, punched tape patterns, or radio transponders such as RFID chips. This type of configuration has the advantage that it enables the user of the cleaning device to be provided with information regarding the use of a correct cleaning element suitable for the surface to be cleaned and also regarding the timely replacement of the cleaning element to maintain cleaning performance. This information can also be communicated via app, for example.

The cleaning performance of the cleaning device can be further improved by accommodating an additional dry-cleaning module in the housing of the cleaning device for dry cleaning of the surfaces to be cleaned. Preferably, the wet-cleaning module and dry-cleaning module are arranged one behind the other in the direction of movement of the cleaning device, wherein the dry-cleaning module is located in front of the wet-cleaning module in the direction of movement during forward travel. The dry-cleaning module can thus be used for pre-cleaning, and it is ensured that the surface to be cleaned, which has been moistened by the wet-cleaning module, can dry and is not smeared by cleaning elements of the dry-cleaning module.

The invention also relates to a method of operating a cleaning device of the type described above, wherein the cleaning element in its cleaning position performs a back-and-forth movement in the manner of a scrubbing movement. Thanks to the fact that the cleaning element not only wipes but also scrubs, firmly adhering dirt can be reliably removed, thus substantially improving the cleaning performance.

The invention described and the described advantageous further embodiments of the invention, in combination with one another—insofar as this is technically feasible—also constitute advantageous further embodiments of the invention.

In FIG. 1, a cleaning device 100 is shown in a bottom view. The cleaning device 100 has a housing 1, in which a drive device 2, a wet-cleaning module 3 and a dry-cleaning module 4 are accommodated. The drive device 2 includes two motor-driven wheels. The dry-cleaning module 4 has a segmented structure and includes two rotatable brushes and a rotatable roller. In a direction of movement V, which is the main movement direction of the cleaning device 100, the dry-cleaning module 4 is located in front of the wet-cleaning module 3. In this way, when moving over a surface 1000 to be cleaned, cleaning can first be carried out by means of the dry-cleaning module 4 and then by means of the wet-cleaning module 3.

The wet-cleaning module 3 has a cleaning element 30 comprising a cleaning surface 37.1., which can be brought into contact with the surface 1000 to be cleaned. The cleaning surface 37.1. has an extension s1 in the movement direction V and an extension s2 perpendicular to the movement direction V, that is, a depth s1 and a width s2. The depth s1 is substantially smaller than the width s2, which essentially extends across the width of the cleaning device 100. As indicated by a double arrow, the cleaning element 30 can be moved back and forth perpendicular to movement direction V, i. e., it can perform a movement from right to left and back again in the drawing plane. In this way, the cleaning element 30 generates a scrubbing movement, resulting in a particularly good cleaning performance of the wet-cleaning module 3. This scrubbing movement is also indicated by a double arrow in FIG. 2*a*.

Figure 2A:
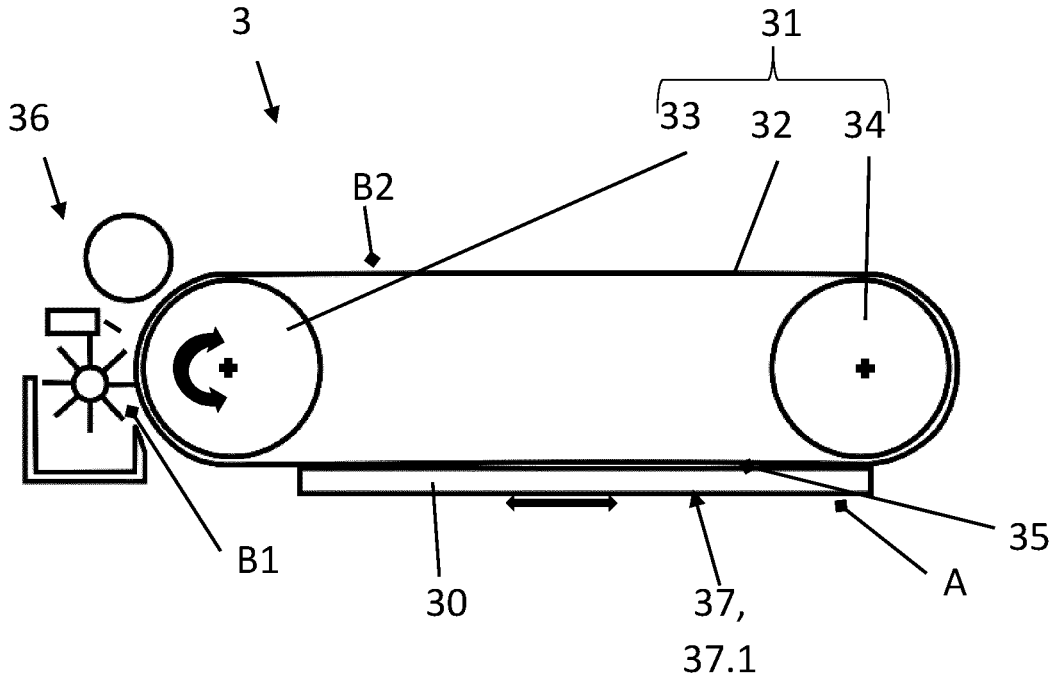
FIG. 2*a* schematically shows the cleaning device in a sectional view.

The sectional view of FIG. 2*a* shows the structure of the wet-cleaning module 3. The wet-cleaning module 3 has a belt-shaped cleaning element 30, which is attached to a circulating belt 32 by fixing means 35. The circulating belt 32 is part of a transport mechanism 31 used to move the cleaning element 30. In addition to the circulating belt 32, the transport mechanism 31 comprises at least one drive roller 33 and a reversing roller 34 around which the circulating belt 32 is routed. The circulating belt 32 is thus configured as an endless belt that is driven by the drive roller 33—as indicated by a double arrow. The wet-cleaning module 3 features three different positions for the belt-shaped cleaning element 30:

- a cleaning position A, in which the cleaning element 30 contacts the surface 1000 to be cleaned and performs cleaning,
- a parking position B2, in which the belt-shaped cleaning element 30 is at a distance from the surface 1000 to be cleaned,
- and a third position, namely a regeneration position B1, which is located between cleaning position A and parking position B2.

In the area of regeneration position B1, a regeneration unit 36 is arranged, which is used to clean the cleaning element 30. The cleaning element 30 is regenerated as it is passed through the regeneration unit 36 by the transport mechanism 31. The regeneration unit 36 can comprise a number of different components, which are marked with reference numerals in FIG. 2*b*: a cleaning brush 36.1, a spraying device 36.2, a squeezing roller 36.3, which acts as a pair of rollers together with the drive roller 33. The components of the regeneration unit 36 are shown by way of example. In addition to the components described, stripping combs, tanks, or disinfecting means can also be provided for example.

Figure 2B:
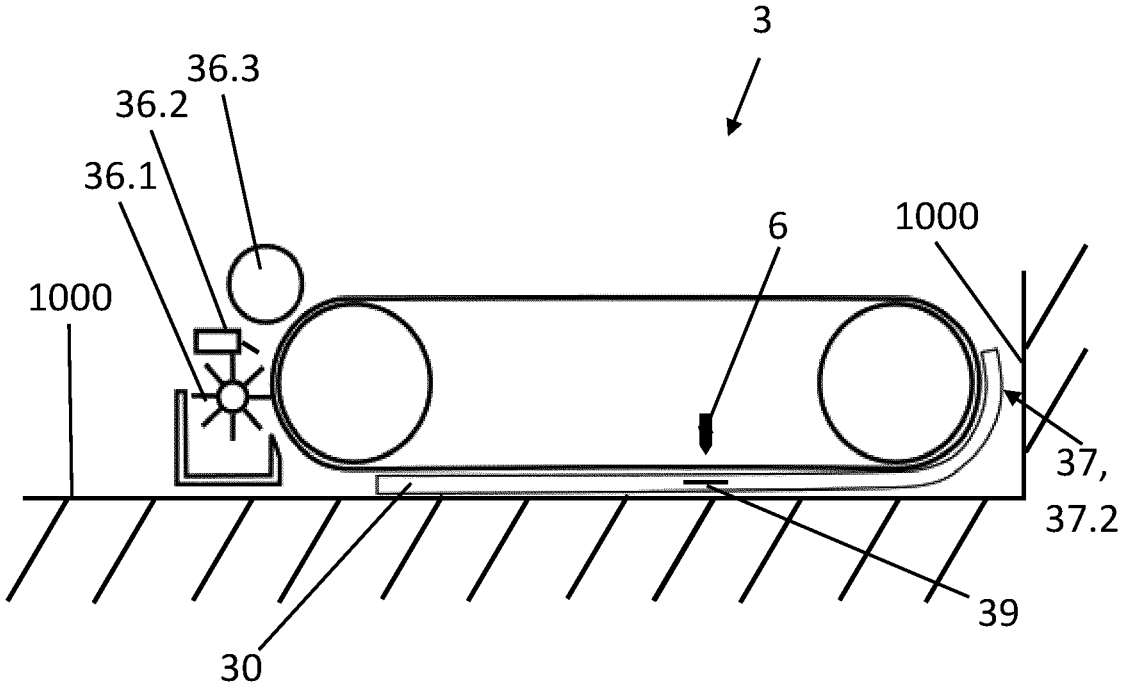
FIG. 2*b* schematically shows an alternative embodiment of a cleaning device in a sectional view.

In FIG. 2*b*, the wet-cleaning module 3 of the cleaning device 100 is shown in a specific application scenario. The cleaning element 30 contacts a surface 1000 to be cleaned, thus performing cleaning of the surface. For this, the cleaning element 30 has a horizontal cleaning surface 37.1., which contacts a horizontal surface 1000 to be cleaned. The cleaning element 30 also has a vertical cleaning surface 37.2 which contacts a vertical surface 1000 to be cleaned. The vertical surface 1000 to be cleaned may be a skirting board, for example, and the horizontal surface 1000 to be cleaned may be a floor, for example.

A sensor 6, for example an optical sensor, is arranged above the cleaning element 30 in its cleaning position A. With the aid of this sensor 6, the cleaning performance can be evaluated. In order to clear the line of sight between sensor 6 and the surface 1000 to be cleaned, the cleaning element 30 must be moved from its cleaning position A to its parking position B2 or at least to its regeneration position B1. The sensor 6 can then detect the condition of the surface to be cleaned. The cleaning element 30 can then be moved back to its cleaning position A and cleaning of the surface 1000 can be carried out. After cleaning has been completed, the cleaning element 30 can be moved back to the regeneration position B1 or to the parking position B2 and another inspection can be carried out by the sensor 6. By comparing the readings before and after cleaning, cleaning performance can be evaluated. Alternatively, it is possible to store reference values in a memory of a control unit of the cleaning element 30 which enable a comparison of ACTUAL values with stored SET values.

A communication means 39 is arranged on the belt-shaped cleaning element 30, which, upon appropriate configuration, can also be read by the sensor 6. Alternatively, however, other detection means could also be provided to read out the communication means 39. The communication means 39 can, for example, be implemented as a data matrix code or as an RFID chip or RFID tag. Information regarding the cleaning device type, a maximum planned and/or already completed number of cleaning cycles, time of first use, etc. can be assigned to the communication means 39.

Figure 3:
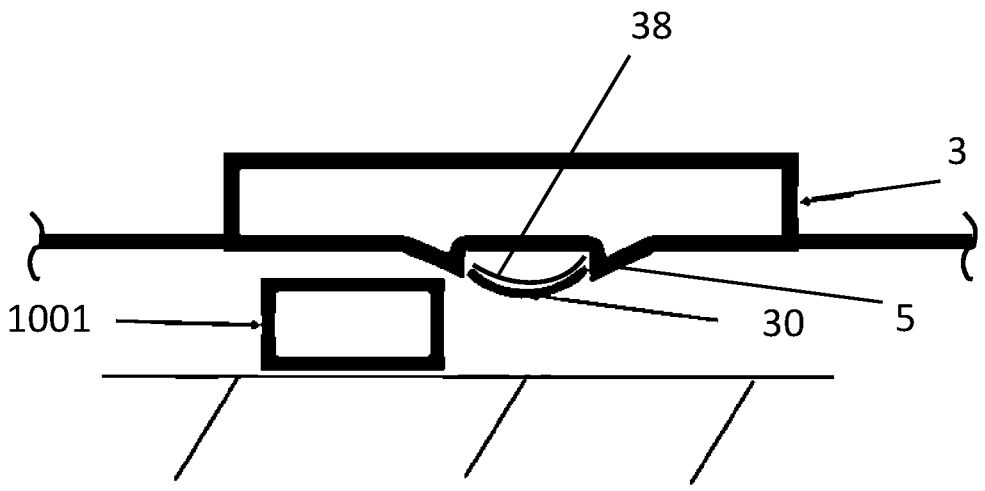
FIG. 3 schematically shows a detailed view of a possible embodiment of a cleaning device.

FIG. 3 shows a detailed view of an embodiment of the wet-cleaning module 3. The cleaning element 30 is made of a belt-shaped textile material, which is provided with plastic elements 38 to stiffen its cleaning surface. In order to prevent the cleaning element 30 being damaged, being pushed off or slipping off in the event of contact with an obstacle 1001 during cleaning, ramps 5 are provided on both sides of the cleaning element 30. These form a safeguard for the cleaning element 30 in the event of it running over an obstacle 1001 during cleaning.

Figure 4:
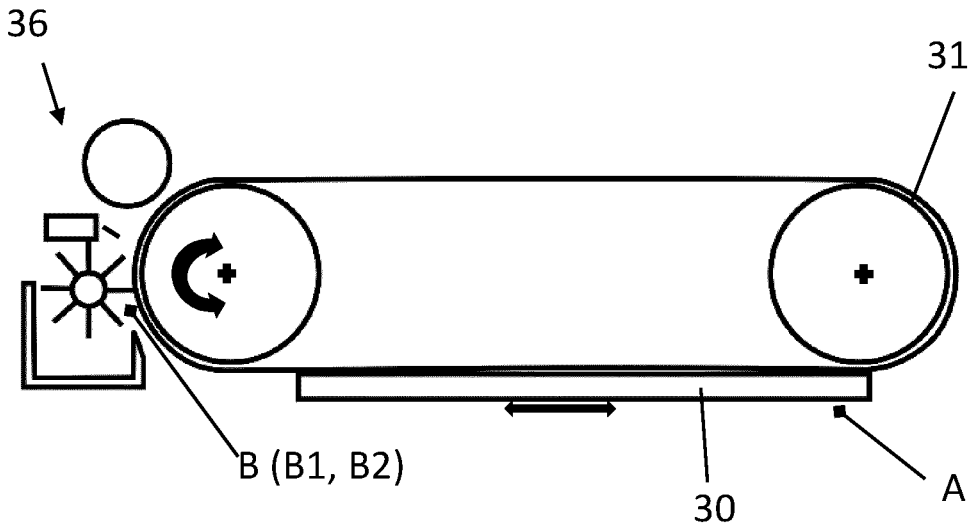
FIG. 4 schematically shows a variant of the cleaning device in a sectional view.

The sectional view of FIG. 4 shows an alternative design of a wet-cleaning module 3. The wet-cleaning module 3 has a belt-shaped cleaning element 30, which can be moved by a transport mechanism 31. The wet-cleaning module 3 features two different positions for the belt-shaped cleaning element 30:

- a cleaning position A, in which the cleaning element 30 contacts the surface 1000 to be cleaned and performs cleaning, and a parking position B2, in which the belt-shaped cleaning element 30 is at a distance from the surface 1000 to be cleaned, whereby position B then functions as regeneration position B1 when regeneration of the cleaning element 30 is carried out there.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 housing
2 drive unit
3 wet-cleaning module
4 dry-cleaning module
5 ramp
6 sensor
30 cleaning element
31 transport mechanism
32 circulating belt
33 drive roller
34 reversing roller
35 position fixing means
36 regeneration unit
36.1 cleaning brush
36.2 spraying device
36.3 squeezing roller
37 cleaning surface
37.1 horizontal cleaning surface
37.2 vertical cleaning surface
38 plastic stiffening element
39 communication means
100 cleaning device
1000 surface to be cleaned
1001 obstacle or object
s1 extension in movement direction
s2 extension perpendicular to movement direction
A cleaning position
B1 regeneration position
B2 parking position
B combined regeneration and parking position
V movement direction

The invention claimed is:

1. A cleaning device, comprising:
a housing;
a drive device configured to automatically move the cleaning device in a movement direction; and
a wet-cleaning module accommodated in the housing, comprising a moveable cleaning element for the wet cleaning of surfaces to be cleaned and a circulating belt,
wherein the cleaning element is arranged on an outer surface of the circulating belt so as to occupy only part of the outer surface of the circulating belt,
wherein the wet-cleaning module has three positions for the cleaning element:
a cleaning position, in which the cleaning element is configured to contact a surface to be cleaned with a cleaning surface,
a parking position, in which the cleaning element is at a distance from the surface to be cleaned, and
a regeneration position located between the cleaning position and the parking position, or a regeneration position located in the parking position in which the cleaning element is configured to be cleaned and/or conditioned, and
wherein the circulating belt is configured to move the cleaning element into its cleaning position, parking position, and regeneration position.

2. The cleaning device of claim 1, wherein the wet-cleaning module includes at least one drive roller and at least one reversing roller configured to move the circulating belt, and
wherein the cleaning element is mounted on the outer surface of the circulating belt by fixing means.

3. The cleaning device of claim 1, wherein the wet-cleaning module has a regeneration unit configured to clean the cleaning element with at least one cleaning brush and/or a stripping comb and/or a spraying device and/or a water tank and/or a pair of squeezing rollers and/or a disinfecting means.

4. The cleaning device of claim 3, wherein the disinfecting means comprises at least one UV lamp.

5. The cleaning device of claim 1, wherein an extension of the cleaning surface of the cleaning element in the movement direction of the cleaning device is smaller than an extension perpendicular to the movement direction of the cleaning device.

6. The cleaning device of claim 1, wherein the cleaning element is movable perpendicular to the movement direction of the cleaning device.

7. The cleaning device of claim 1, wherein a cleaning surface of the cleaning element comprises a textile material.

8. The cleaning device of claim 7, wherein the cleaning element comprises plastic elements configured to stiffen the cleaning surface.

9. The cleaning device of claim 1, wherein the cleaning element has, in the cleaning position, a horizontal cleaning surface configured to clean a horizontal surface and a vertical cleaning surface configured to clean a vertical surface.

10. The cleaning device of claim 1, wherein a cleaning surface of the cleaning element is convexly curved, at least in regions, and/or
wherein the cleaning surface lies between ramps which are raised relative to edges of the cleaning surface.

11. The cleaning device of claim 1, wherein the cleaning device comprises at least one sensor comprising an optical sensor configured to detect a surface to be cleaned and to determine cleaning performance.

12. The cleaning device of claim 1, wherein the at least one sensor is arranged above the cleaning element and is activatable when the cleaning element is outside of its cleaning position.

13. The cleaning device of claim 1, wherein the cleaning element comprises a communication means configured to communicate with the cleaning device.

14. The cleaning device of claim 1, further comprising:

a dry-cleaning module accommodated in the housing configured to dry clean surfaces to be cleaned, wherein the wet-cleaning module and the dry-cleaning module are arranged one behind another in the movement direction of the cleaning device, and wherein the dry-cleaning module is located in front of the wet-cleaning module in the movement direction.

15. A method for operating the cleaning device of claim 1, comprising:

performing a back-and-forth movement of the cleaning element as a scrubbing movement in the cleaning position.

* * * * *